US008418641B2

(12) United States Patent
Ribesen et al.

(10) Patent No.: US 8,418,641 B2
(45) Date of Patent: Apr. 16, 2013

(54) DEVICE AND METHOD FOR FORMING AN ANCHOR SPREAD

(75) Inventors: Bjørn Thore Ribesen, Sandvika (NO); Arild Saasen, Lier (NO); Espen Lea, Sola (NO); Knut Ove Steinhovden, Sandnes (NO); Steinar Ekrem, Alesund (NO)

(73) Assignee: Viking Moorings AS, Stavanger (NO)

( * ) Notice: Subject to any disclaimer, the term of this patent is extended or adjusted under 35 U.S.C. 154(b) by 7 days.

(21) Appl. No.: 13/266,741

(22) PCT Filed: Feb. 2, 2011

(86) PCT No.: PCT/NO2011/000042

§ 371 (c)(1),
(2), (4) Date: Nov. 9, 2011

(87) PCT Pub. No.: WO2011/102730

PCT Pub. Date: Aug. 25, 2011

(65) Prior Publication Data

US 2012/0067267 A1 Mar. 22, 2012

Related U.S. Application Data

(60) Provisional application No. 61/412,282, filed on Nov. 10, 2010.

(30) Foreign Application Priority Data

Feb. 3, 2010 (NO) ..... 20100175
Nov. 10, 2010 (NO) ..... 20101589

(51) Int. Cl.
*B63B 21/24* (2006.01)

(52) U.S. Cl.
USPC ..... 114/293; 114/294

(58) Field of Classification Search ..... 114/293, 114/230.1, 230.2–6, 294
See application file for complete search history.

(56) References Cited

U.S. PATENT DOCUMENTS 2,986,888 A * 6/1961 Borrmann et al. ..... 405/224
3,151,594 A * 10/1964 Collipp ..... 114/293

(Continued)

FOREIGN PATENT DOCUMENTS

WO WO 99/10228 A1 3/1999
WO WO 01/32501 A1 5/2001
WO WO 02/10010 A1 2/2002

*Primary Examiner* — S. Joseph Morano
*Assistant Examiner* — Jovon Hayes
(74) *Attorney, Agent, or Firm* — Birch, Stewart, Kolasch & Birch, LLP

(57) ABSTRACT

The invention is a method for mooring a marine vessel (P) using three or more anchor lines (11*a*, 11*b*, . . . ) comprising—laying out each anchor line (11) with an anchor in a desired position relative to the platform, with a seabed anchor chain (10) extending towards the desired position of the platform (P), with the seabed chain (10) connected to a fiber rope's (20) arranged for being extended through the sea and connected to an anchor winch chain (30) and being tightended by an anchor winch (31) on the vessel (P), wherein the fiber rope (20) is prepared by being packed to a bundle or coil (21) arranged in a protective container (24) on the seafloor, and arranged for being released and pulled out of the container (24) at a predetermined pulling force, and arranged for being picked up and connected to the anchor winch chain (30).

12 Claims, 13 Drawing Sheets

U.S. PATENT DOCUMENTS

| | | | | |
|---|---|---|---|---|
| 3,865,064 | A * | 2/1975 | Van Heijst | 114/293 |
| 3,977,448 | A * | 8/1976 | Botting | 114/210 |
| 4,067,282 | A * | 1/1978 | Guinn et al. | 114/230.2 |
| 5,061,131 | A * | 10/1991 | Petty et al. | 405/224 |
| 5,222,453 | A * | 6/1993 | Chabot | 114/230.22 |
| 5,566,636 | A * | 10/1996 | Wolf et al. | 114/230.12 |
| 5,937,780 | A * | 8/1999 | Etheridge et al. | 114/230.2 |
| 6,216,628 | B1 * | 4/2001 | Poldervaart | 114/293 |
| 6,467,423 | B1 * | 10/2002 | Poldervaart | 114/293 |
| 6,719,496 | B1 * | 4/2004 | Von Eberstein | 405/224 |
| 6,983,714 | B2 * | 1/2006 | Dove et al. | 114/293 |
| 7,044,817 | B2 * | 5/2006 | Bech | 441/5 |
| 7,421,967 | B1 * | 9/2008 | Fontenot et al. | 114/230.24 |
| 8,100,077 | B2 * | 1/2012 | Collee et al. | 114/230.2 |
| 2002/0166698 | A1 | 11/2002 | Beato et al. | |
| 2002/0189522 | A1 | 12/2002 | Dove et al. | |
| 2003/0031517 | A1 | 2/2003 | Wetch | |
| 2005/0241558 | A1 | 11/2005 | Barlow | |
| 2007/0022934 | A1 * | 2/2007 | Lee et al. | 114/293 |
| 2007/0240624 | A1 * | 10/2007 | Collee et al. | 114/230.23 |
| 2009/0084302 | A1 * | 4/2009 | Daran et al. | 114/293 |

* cited by examiner

DEVICE AND METHOD FOR FORMING AN ANCHOR SPREAD

The invention relates to an improvement of an anchor spread for a marine floater (P). The marine floater (P) may be a drilling platform, a drilling ship, a production platform, or a large buoy. The usual procedure is to lay out eight anchors (2*a*, 2*b*, . . . , 2*h*) in a suitable pattern, e.g. approximately in a circular array about the platform (P), each anchor with its appurtenant anchor line (11*a*, 11*b*, . . . , 11*h*) in an approximately star-shaped anchor spread lay-out about the platform (P). Each anchor line (11) from each anchor (2) comprises a heavy seabed-anchor chain (10) of between 120 kg/m and 180 kg/m and arranged for extending from said anchor (2) and about 1000 m along the seabed in towards a so-called "touch-down"-point (TD) where the anchor line has a transition into a somewhat lighter anchor line arranged for hanging along a geometrical catenary line (if all links are equally heavy) further between the seabed and up to the platform. Due to the sea state and the platform movements it is in many instances desirable to arrange an anchor line fibre rope (20) of large diameter, preferably 150 to 170 mm, and rather 1000 m of length or 1.5 times the sea depth, with a weight of about 5 kg/m when submerged (which is rather light), in the range between the seabed-anchor chain (10) and a relatively short platform anchor winch chain (30) which is tightened up to a length of about 100 to 300 meters and forms the upper mechanically capable part of the anchor line (11) in to an anchor chain winch (31) on the platform (P).

Problem to be Solved

It is quite common practice to tow the platform out using tugboats, and place the platform (P) in an approximately desired central mooring position before laying out the anchor spread, please see FIG. 1. One then applies three or four AHV's, i.e. anchor handling vessels (3) for laying out the anchor lines. An anchor handling vessel (3) first lays out one anchor, e.g. "anchor #1", here with the reference numeral (2*a*) and extends the seabed anchor chain (10) and further the fibre rope (20) and connects this to the platform anchor winch chain (30), all while tugboats hold the platform in an approximately desired position by pulling in the opposite direction after the connection. Laying out and connecting one such anchor line (11) may take about 22 to 24 hours. The anchor handling vessels may subsequently lay out anchor #2 (2*e*) in an opposite direction relative to anchor #1, (2*a*), and so on, until all eight anchors (2*a*, 2*b*, . . . , 2*h*) with corresponding anchor lines (11*a*, 11*b*, . . . , 11*h*) have been laid out and connected to the platform. A considerable problem is the fact that this procedure may have long duration, and that a sufficiently long weather window with a required sufficiently low sea state may be difficult to forecast or achieve.

It is possible to lay out anchors (2) and anchor chain, here called seabed chain (10) in advance at the seabed and connect a 90 mm wire extending from the anchor chain (10) to a so-called 10-T buoy (having a buoyancy lift capacity of 10 tons) at the sea surface so as for making a preinstalled lay-out of all anchor lines before the platform is brought in place, for subsequently connecting the thick anchor wires with the platform anchor line chain (30) and tighten all. But if one should prefer to use a synthetic fibre rope (20) as a main part of the part of the platform anchor line extending between the anchor chain (20) at the seabed and a buoy at the surface, this will generally be longer than the corresponding sea depth, and a considerable proportion of the synthetic fibre rope will thus lie rather free and swing along the seabed. The synthetic fibre rope may thus be subject to damage or cuts or gnawing against objects on the seabed or wires in the sea, fishing gear, etc., or be subject to undesired buckling due to loops accidentally formed.

SHORT SUMMARY OF THE INVENTION

A solution to the above-mentioned problems is, according to a first aspect of the invention, a method of mooring a marine vessel (P) in a desired position by means of three or more anchor lines (11*a*, 11*b*, . . . ) comprising the following steps:

laying out each anchor line (11) with an anchor (2) at a desired position with regard to said platform (P), with a seabed chain (10) extending in the direction of the platform's (P) desired position, with the seabed chain (10) connected to a synthetic fibre rope's (20) first end (27), said synthetic fibre rope (20) arranged for being extended through the sea and being connected with its opposite, second end (22) to an anchor winch chain (30) and being tightened by an anchor winch (31) on said vessel (P), The novel and characterising of the invention is:

said synthetic fibre rope (20), prior to the step of connecting with the anchor winch chain (30), is entirely or partially packed to a bundle or coil (21) arranged in a protective container (24) arranged at the seabed, said synthetic fibre rope (20) arranged for being released and pulled out of said container (24) at a predetermined least pulling force directly or indirectly at said synthetic fibre rope's second end (22), and said second end (22) of said synthetic fibre rope (20) being prepared for being picked up for connection with said anchor winch chain (30).

The anchor spread is thus prepared for receiving a platform for being moored in the desired position. For completing the mooring operation one must eventually necessarily further conduct the steps of:

placing the vessel (P) in the desired position, picking up each synthetic fibre rope's other end (22) and connect those with their appurtenant anchor winch chains (30), tightening of said anchor winch chains (30) by means of anchor winches (31) until the vessel or platform (P) resides in the desired position.

The invention is, according to another aspect, a mooring component for use in an anchor spread layout for mooring a marine vessel (P), wherein a first, outer end (27) of a synthetic fibre rope (20) is arranged for being connected to a seabed chain (10) which shall extend to an anchor (2), and with an opposite, inner end (22) of said synthetic fibre rope arranged for being connected to an anchor winch chain (30) to an anchor winch (31) of said vessel (P), characterised by said synthetic fibre rope (20) being packed to a bundle or coil (21) arranged in a protective container (24) and arranged for being released and pulled out from said container at a given pulling force directly or indirectly at a second end (22) of said synthetic fibre rope (20), said bundle or coil (21) arranged for being arranged at the seabed with said second end (22) prepared for being picked up for connecting to said anchor winch chain (30).

Advantages of the Invention

An advantage of the invention is that an advance layout of anchor lines may be formed. It is easier, faster and less heavy to fish up ends of said synthetic fibre ropes (20*a*, 20*b*, . . . , 20*h*) and connect them with the platform anchor chains (30).

The equipment and the method according to the invention makes it easier than layout of anchor lines according to the background art because the time-consuming process of laying out the eight anchors (1) and seabed anchor chains (10) is already carried out when the platform arrives, one only have to fish up the end of one by one synthetic fibre rope and make the connection, because all eight (in this case eight anchor lines) synthetic fibre ropes are laid out beforehand, and are easier to handle than wire or chain.

The anchor handling vessels used for the picking up and fishing of the synthetic fibre ropes (20) and the connection of those with the platform anchor chains (30) (or directly to the platform) may be of smaller size and thus less expensive to use than large anchor handling vessels used for laying out specifically the anchors (2) and the seabed chains.

With a protective container (24) arranged about the bundle or coil (21) of the synthetic fibre rope (20) both during lowering and while the bundle (21) resides at the seabed, the synthetic fibre rope is protected from being moved by sea currents and also from damages from sharp objects as wreckage, anchors, chains, wires, etc., which it may touch.

FIGURE CAPTIONS

The invention is illustrated in the attached drawings, wherein

FIG. 1*a* illustrates an anchor line spread connected to a rig or vessel (P), wherein a synthetic fibre rope (20) is arranged between the seabed-extended anchor chain (10) and the anchor line chain (30) of an anchor winch on the platform. There is, in the prior art, arranged a wire and a 10 ton buoy for the connection between the seabed-extended chain and the anchor line chain because the synthetic fibre (20) should not reside freely on the seabed due to the risk of damage of the rope.

FIG. 1*b* shows an anchor handling vessel connecting such a synthetic fibre rope to an anchor line chain before lowering it to the sea and tightening it.

FIG. 2 shows a simplified section and elevation view through an anchor line spread with two oppositely directed anchor lines of the anchor line spread extended towards, and connected to, a platform P. The synthetic fibre ropes constitute a major proportion of the anchor line between the seabed and the surface.

FIG. 3 shows a general illustration of an embodiment of the invention wherein the seabed anchor chain (10) is connected to a first end of a bundle or coil (21) of the synthetic fibre rope (20), and wherein a second end (22, see FIG. 6*a*) of the synthetic fibre rope is laid ready for being caught and fished up to the surface for connecting to the anchor line chain (30) from the anchor winch (31, FIG. 4). For catching the second end (22) is here shown a line with a spring buoy which may be released and picked up at the surface.

Figure 1A:
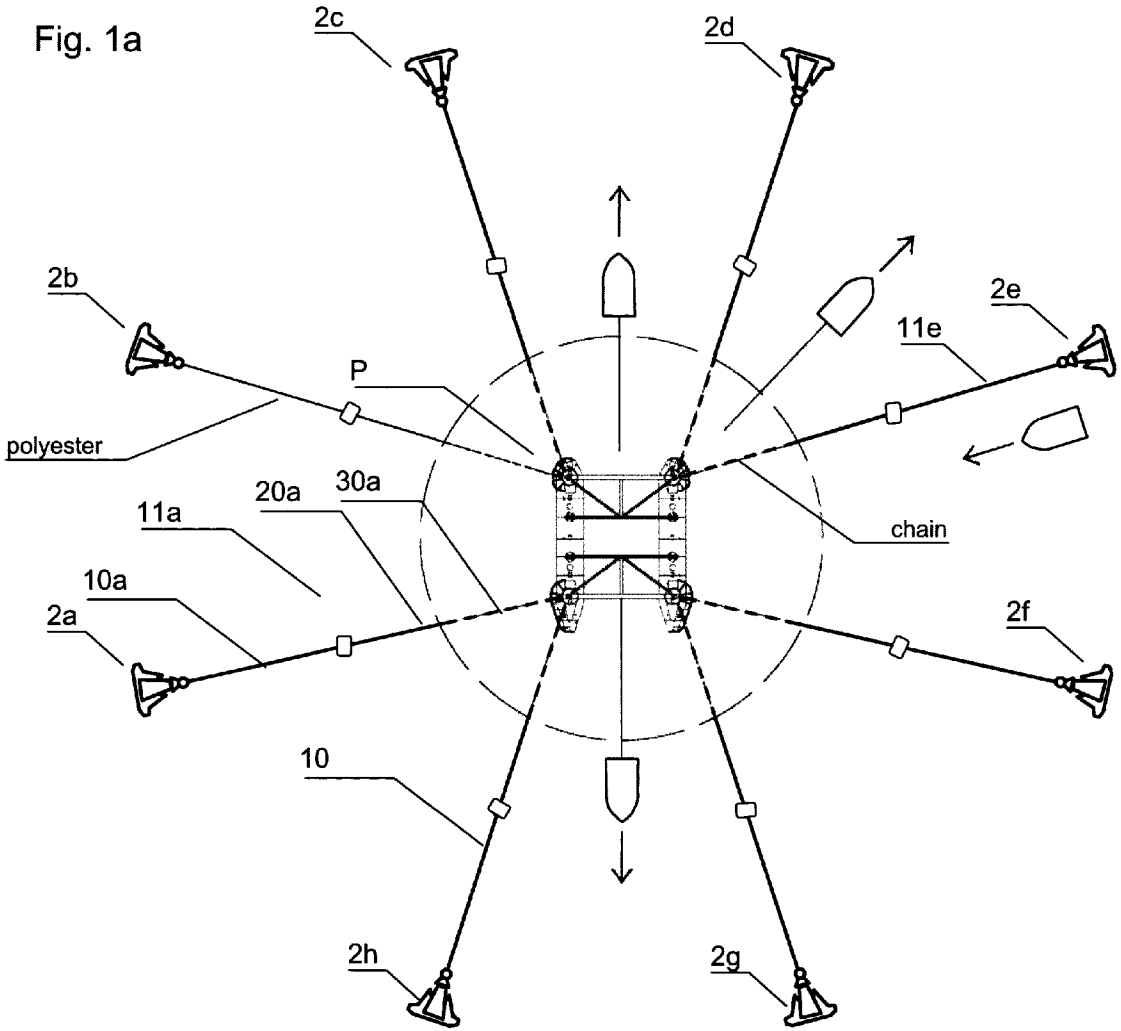
Figure 1B:
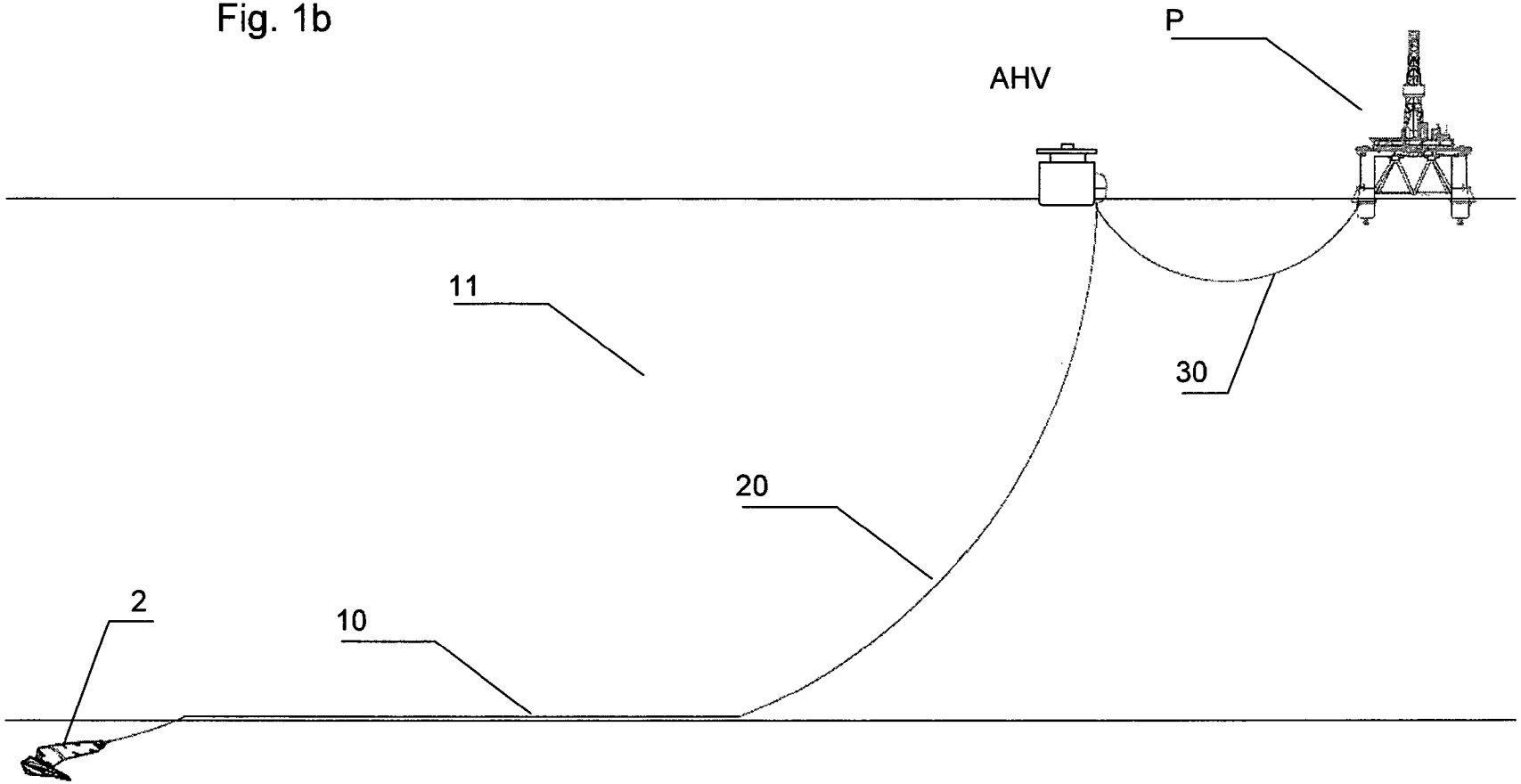
Figure 2:
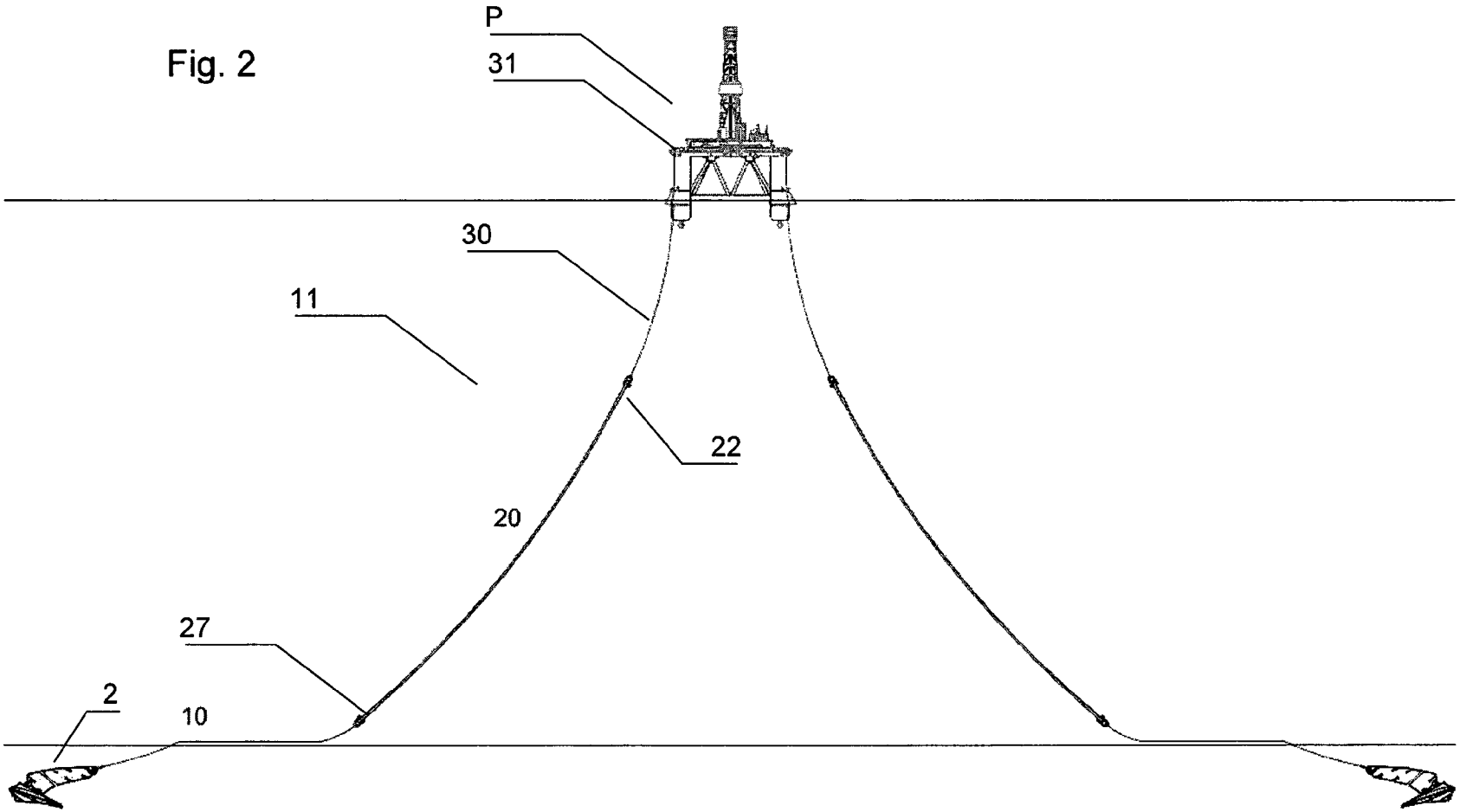
Figure 3:
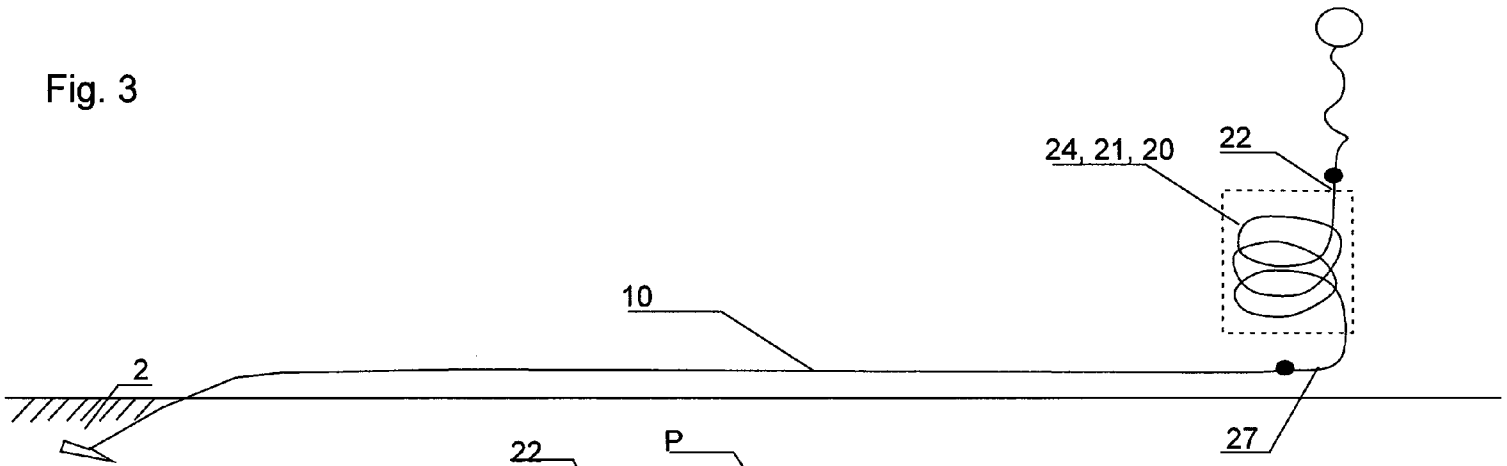
Figure 4:
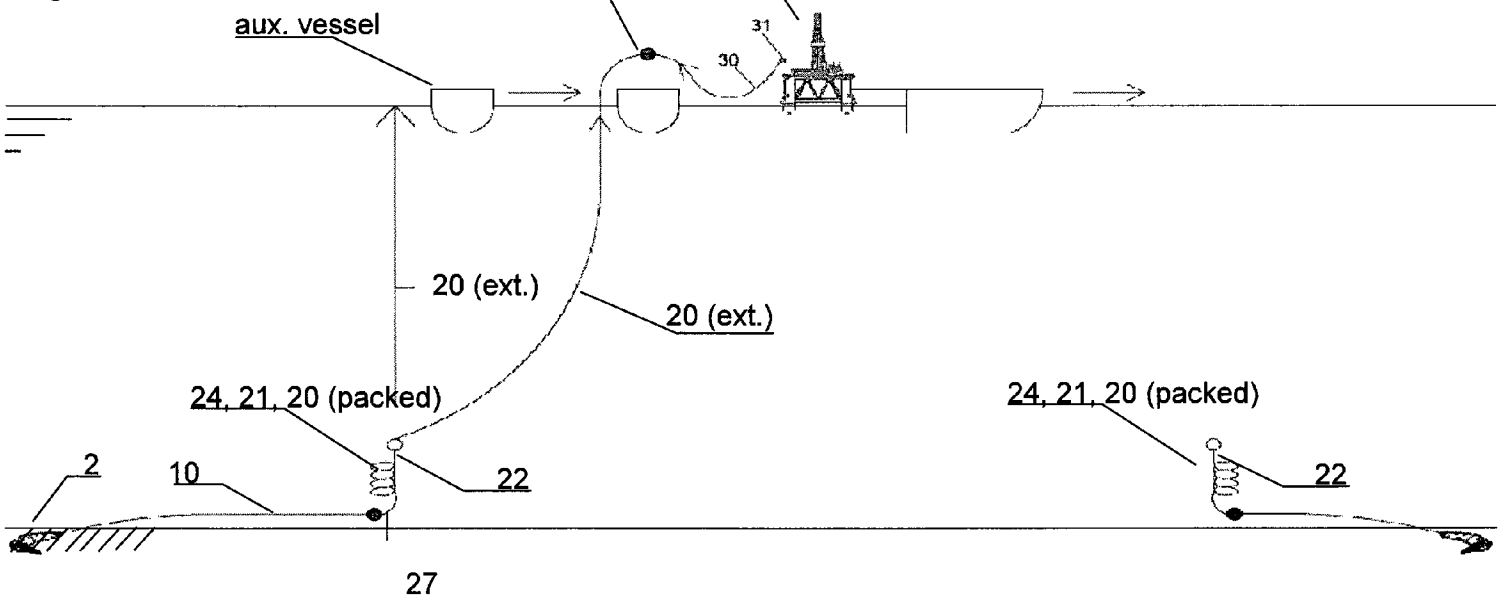
FIG. 4 shows, in a simplified elevation view, a first auxiliary vessel having picked up an end (22) of the synthetic fibre rope (20, "(packed)") and pulled it out from the coil or bundle (21) and has connected the extended synthetic fibre rope (20, "(ext.)") to an end of the anchor line chain (30) which has been fed out by the anchor winch (31) of the platform (P).
Figure 5:
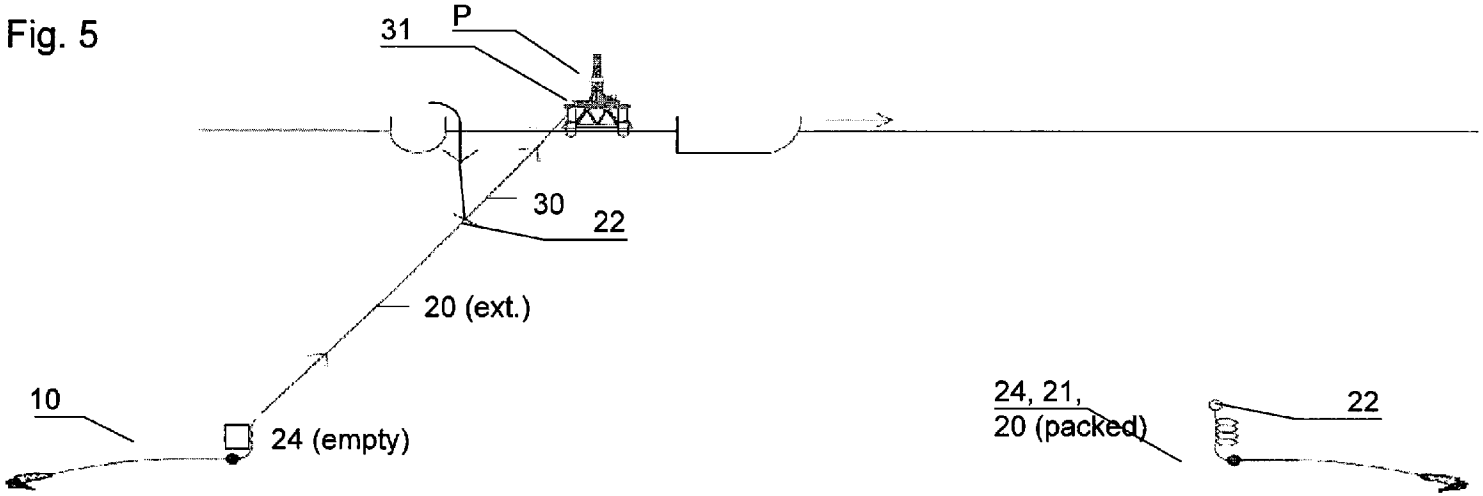
FIG. 5 shows the platform's anchor winch (31) hauling in (and later tightens) the anchor line (11, 30, 20, 10, 2).
Figure 6A:
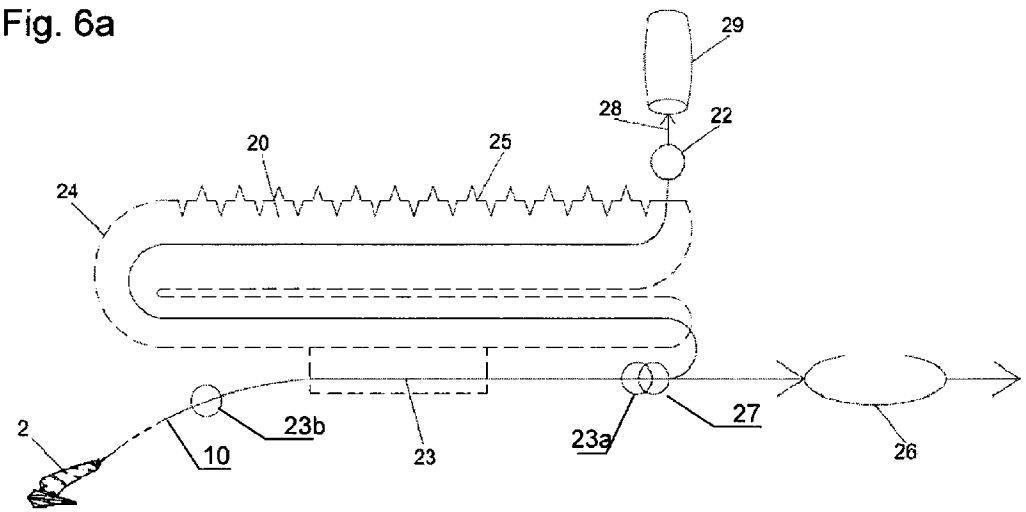

FIG. 6*a* shows a general view of an embodiment of the bundle or coil (21) with the bundled synthetic fibre rope (20) packed into a container or sack 824) and connected to a seabed anchor chain (10) and provided with a connector (26) to a pulling line for laying out the assembled package with anchor (2), seabed chain (10), and bundle/coil (21), which will lie ready for being picked up for connection to an anchor line chain when extended up to the surface with its end (22).

Figure 6B:
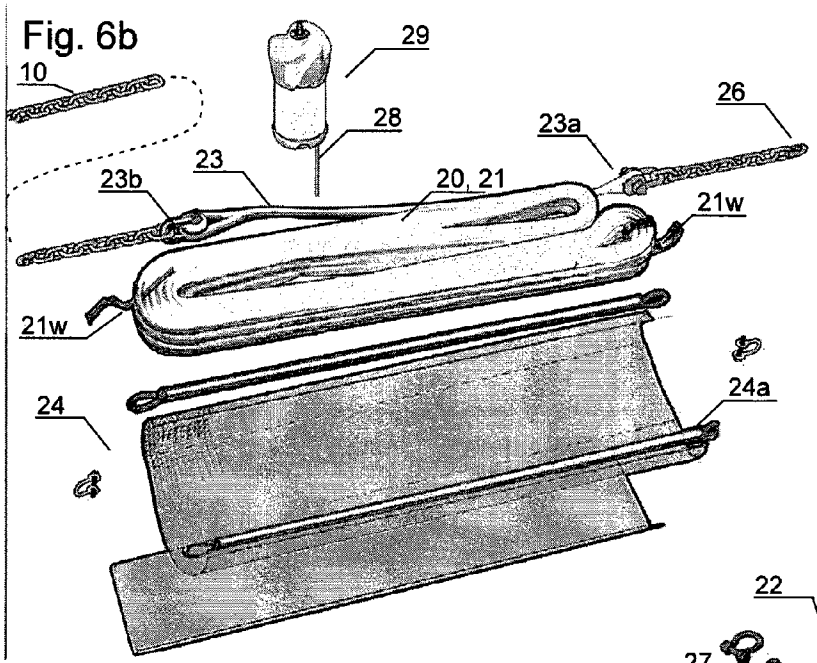

FIG. 6*b* shows an embodiment of the invention made more specific than what is shown in FIG. 6*a*. At the bottom is shown an opened textile container (24) prepared for receiving and enveloping, as a sack, a packed bundle (21) of synthetic fibre rope (20). A heavy stiff wire (23) is arranged in the container for forming a connection between [with] the seabed chain. Parallel ropes (24*a*) which extend along the bundle (21) form brims of an aperture for letting the synthetic fibre rope (20) run out between the ropes (24*a*) when it is released from the textile container. The parallel ropes (24*a*) and thus the textile container is sealed using weak links (24*b*) in order to keep it all assembled during the lay-out process of the seabed anchor chain (10). In order to avoid distortions of the rather rigid fibre rope (20) during the feeding out, it may be bundled as a packed bundle (21) having a horseshoe-shape, in contrast to a coil which usually will incur twisting during the feeding out process.

Figure 6F:
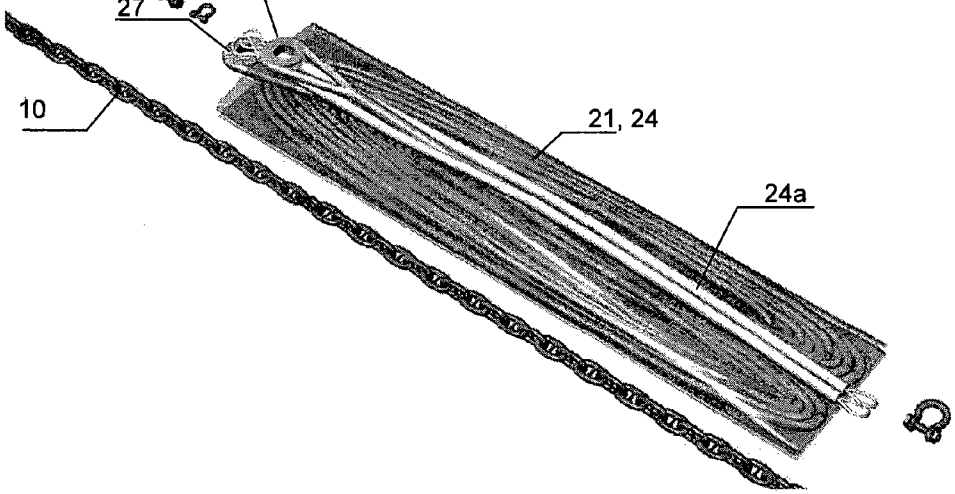
Figure 6C:
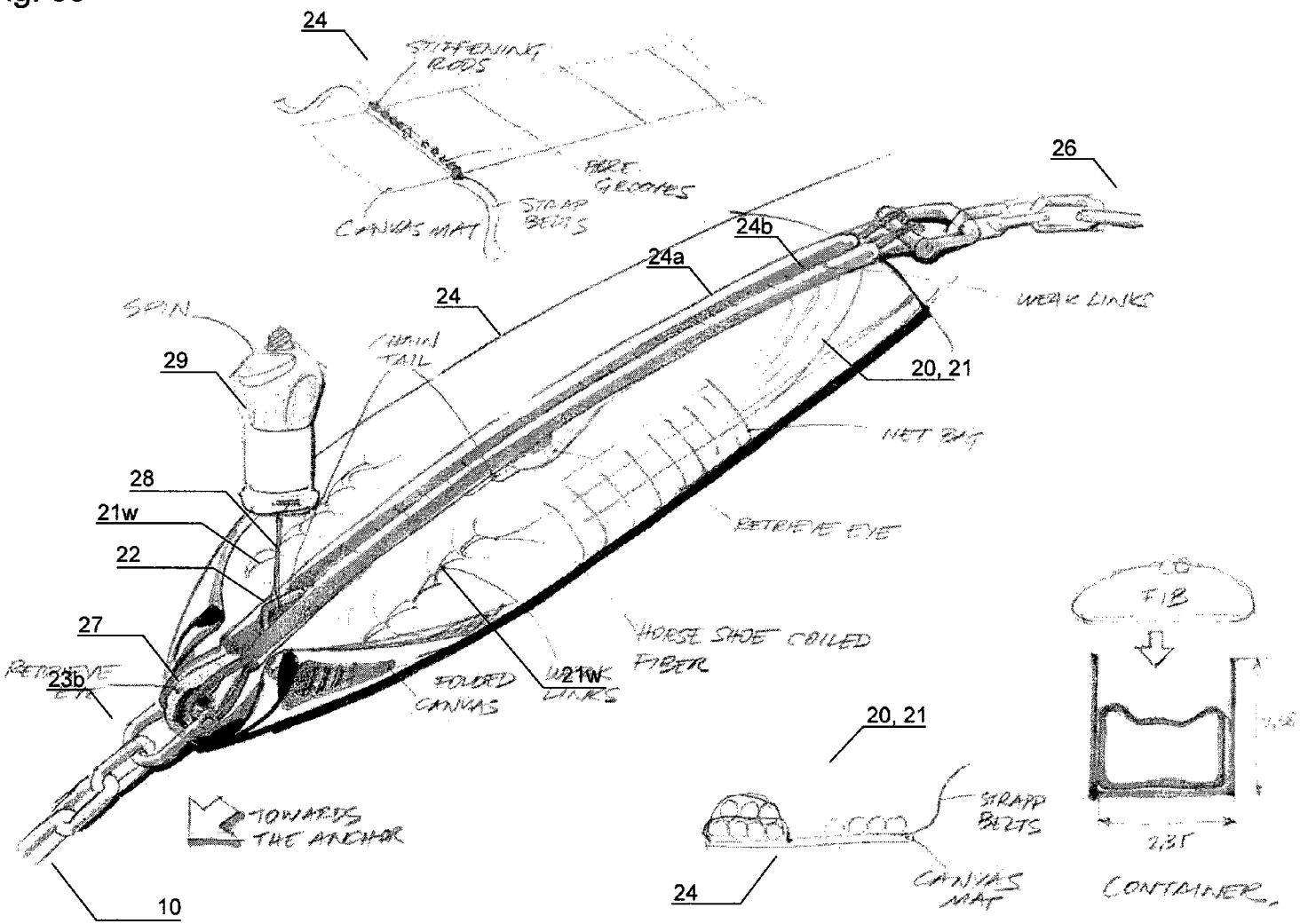

FIG. 6*c* shows in the main illustration a packed stage of an embodiment of the invention wherein the textile container (24) now has been closed about the packed bundle (21) of synthetic fibre rope (20), and wherein the parallel ropes (24*a*) which form the brims of the textile container, are mutually connected by means of transversely arranged weak links (24*b*) for keeping it all assembled during the lay-out process of the seabed anchor chain (10). In the upper part of the drawing is shown a folded out canvas (24) with transversely arranged stiffening rods and strap belts for keeping the bundle (21) in place during and after packing, such as illustrated in the lower part of the drawing. In the lower right portion of the sheet is illustrated a cross-section of a container of width 2.35 m and height 2.38 m wherein the packed textile container (24) has the packed bundle (21) within. As appears from the figure the packed bundle (21) is of significant proportions.

Figure 6D:
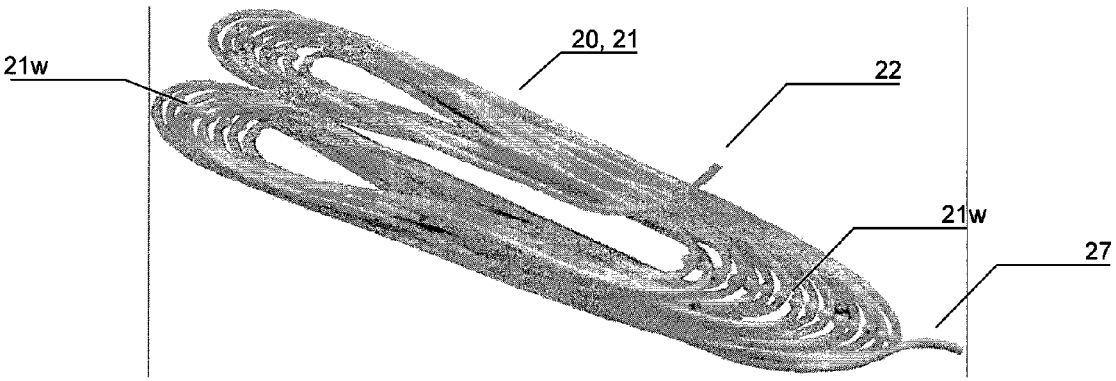

FIG. 6*d* is an image-like rendition of a bundle (21) of fibre rope (20), packed with a first end (27) arranged for being connected to the seabed anchor line, and with a second end (22) arranged for being connected, in the first instance, to the spring buoy line (28), and by means of the anchor winch chain of the platform, and with weak links (21*w*) for providing a non-twisting feeding out of the fibre rope from the bundle (21).

Figure 6E:
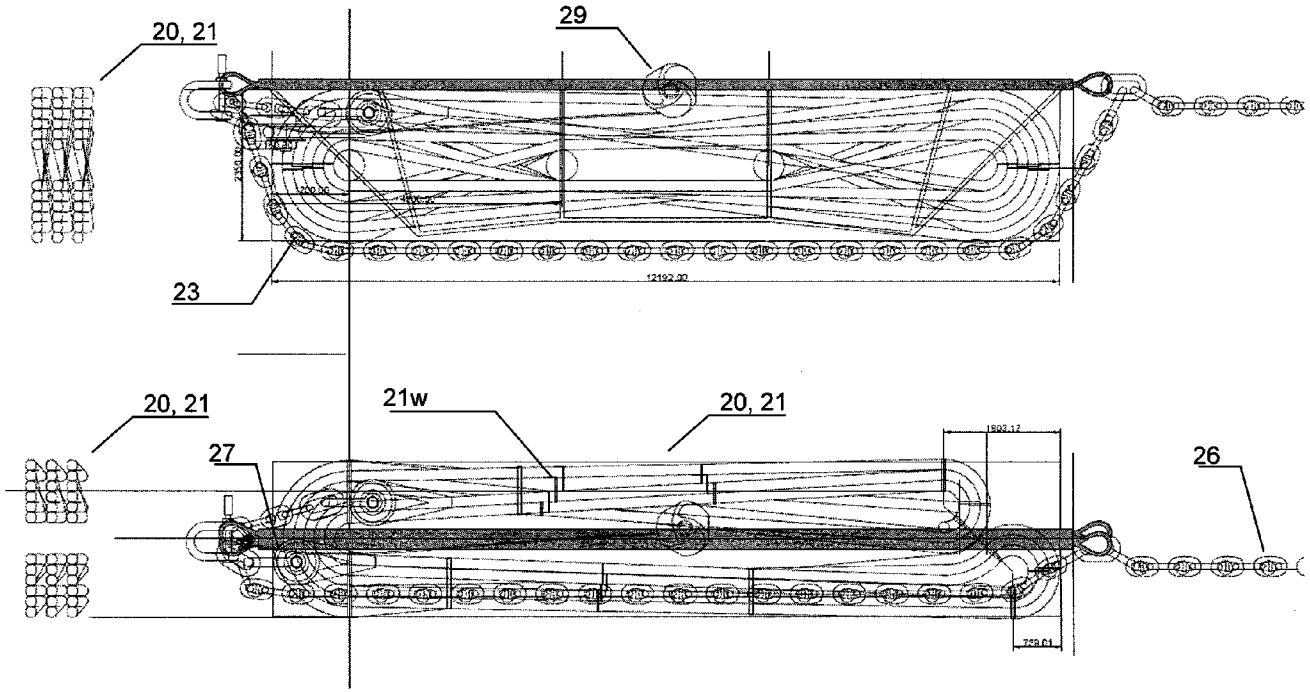

FIG. 6*e* shows an example embodiment of a fibre rope bundle (21) packed with a spring buoy (29), ready for being connected to a seabed anchor chain and being laid out on the seabed. The fibre rope bundle may have considerable size, and the one illustrated here may have a length of twelve meters.

FIG. 6*f* shows an example embodiment of a fibre rope bundle (21) which resembles the embodiment of FIG. 6*c*, here backed as a bundle (21) with weak links (see FIG. 6*d*) and enveloped by a sack (24) with ropes (24*a*) spanned out for forming an aperture of the sack, and with one end (22) of the fibre rope sticking out and arranged for breaking the aperture when being pulled by the spin buoy line (28) belonging to the spin buoy (29). The opposite end is arranged for being attached to the seabed anchor chain (10). The entire package (21, 24, 24*a*) may thus be attached to the seabed anchor chain prior to laying it out by means of the shackles shown. The seabed anchor chain (10) may thus constitute its own stem (23) and pulling end (26) for laying out the package (21, 24).

Figure 7:
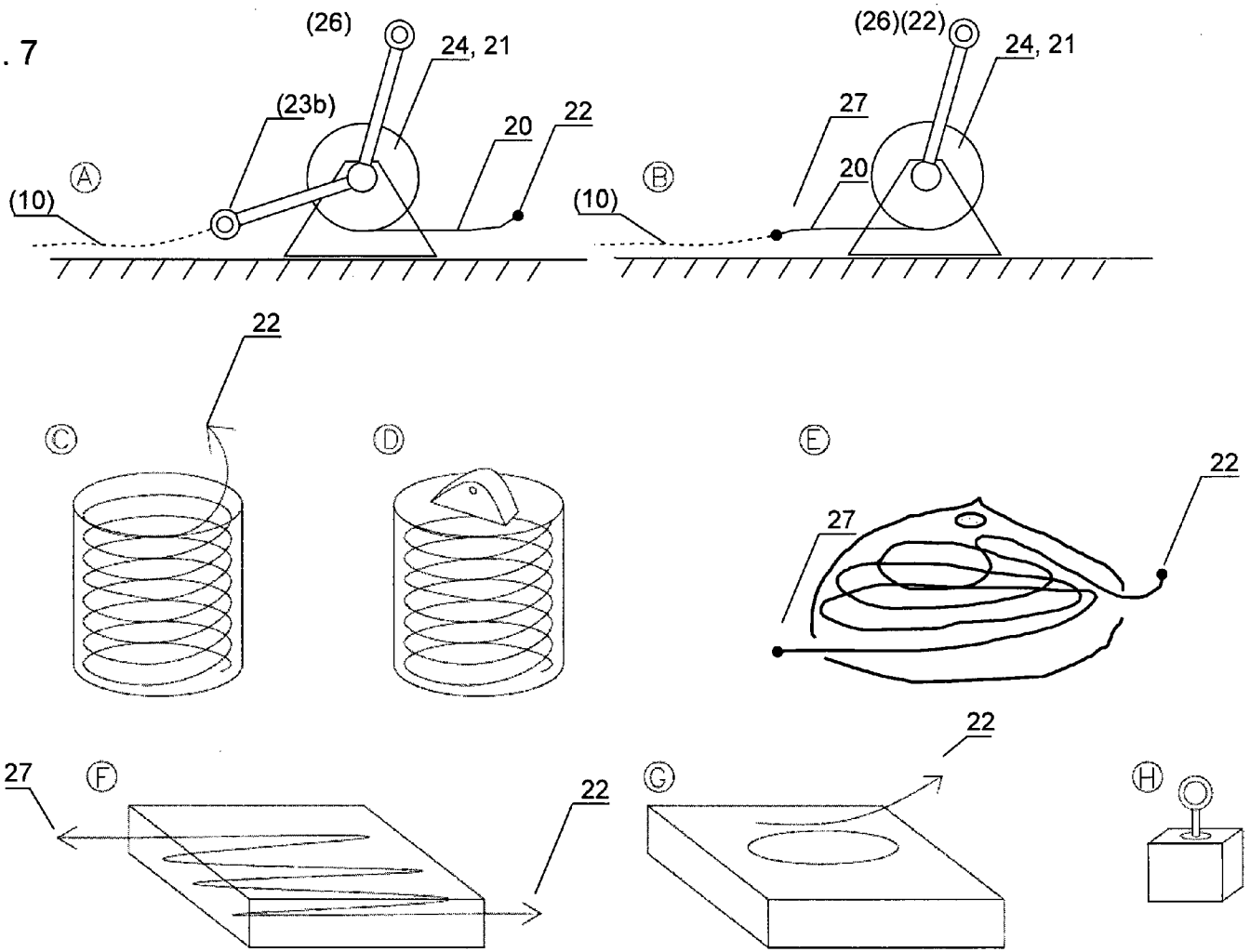

FIG. 7*a* shows several alternatives A, B, C, . . . , G for containers/coils: drums, buckets, open cylinders, sacks, bundles, boxes. FIG. 7*a* illustrates a drum arranged with a link from the drum axle arranged for connecting to the seabed chain (10) and wherein the synthetic fibre drum (20) may be rolled out of the drum (24) and where said drum may be lifted via a second link (26') for launching.

Figure 8:
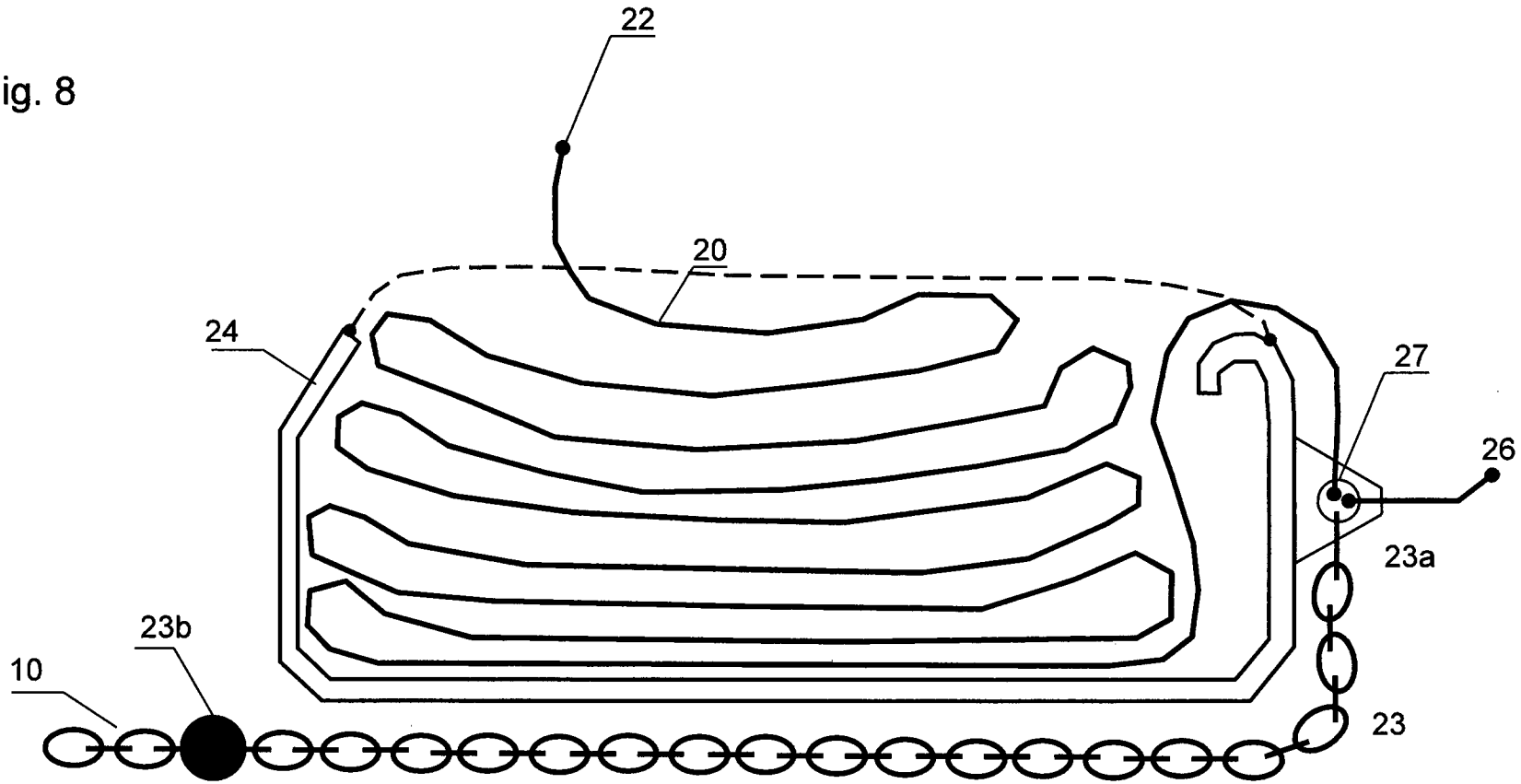

FIG. 8 shows such an alternative embodiment of the invention with a steel box formed as a container (24) for the bundle (21) for synthetic fibre rope. The container (24), here in the box-shaped embodiment, may have tapered-off walls so as for protecting against being hooked by trawling equipment. The bundle with synthetic fibre rope (20) is connected via the lifting eyelet to a first end (23*a*) of a chain support body (23) arranged for being connected with the opposite end (23*b*) of the chain support body (23) to the seabed chain (10). A temporary cover is arranged for holding the bundle of synthetic fibre rope in place during placing of the anchor chain and the box (21) onto the seabed and arranged for opening when one starts hauling up the so formed inner end (22) of the synthetic fibre rope, e.g. by means of a spring buoy (29).

Figure 9:
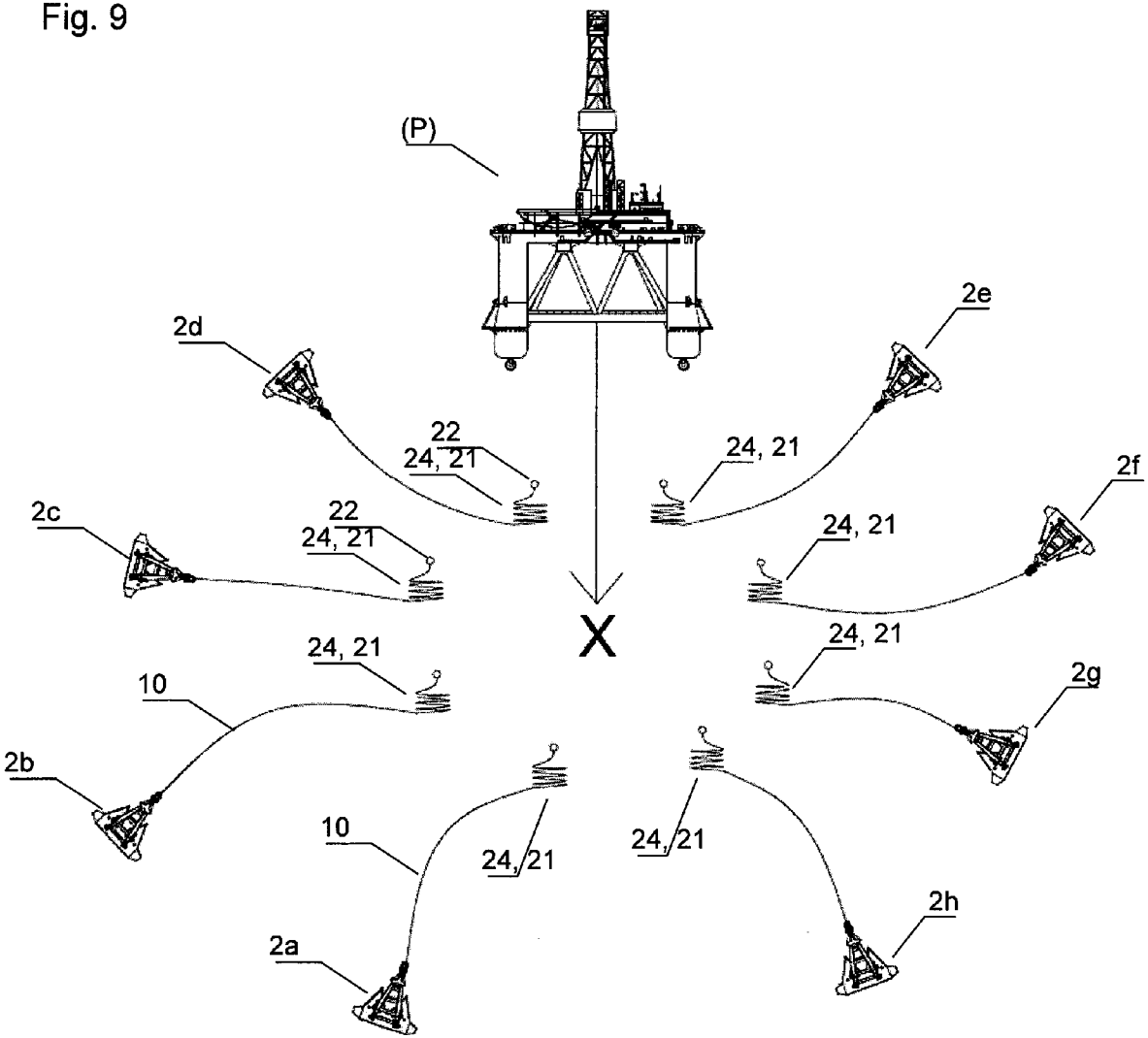

FIG. 9 shows a perspective view of a seabed whereupon is laid out eight bundles (21) of synthetic fibre rope (20) and laid-out anchor chains (10) and anchors (2), said ends (22) of synthetic fibre ropes being ready for being picked up and connected to the anchor line chains of the platform. the platform may thus be connected via the synthetic fibre ropes in a significantly shorter time than what is usual and one will thus not become dependent on such a long weather window as with the prior art.

Figure 10:
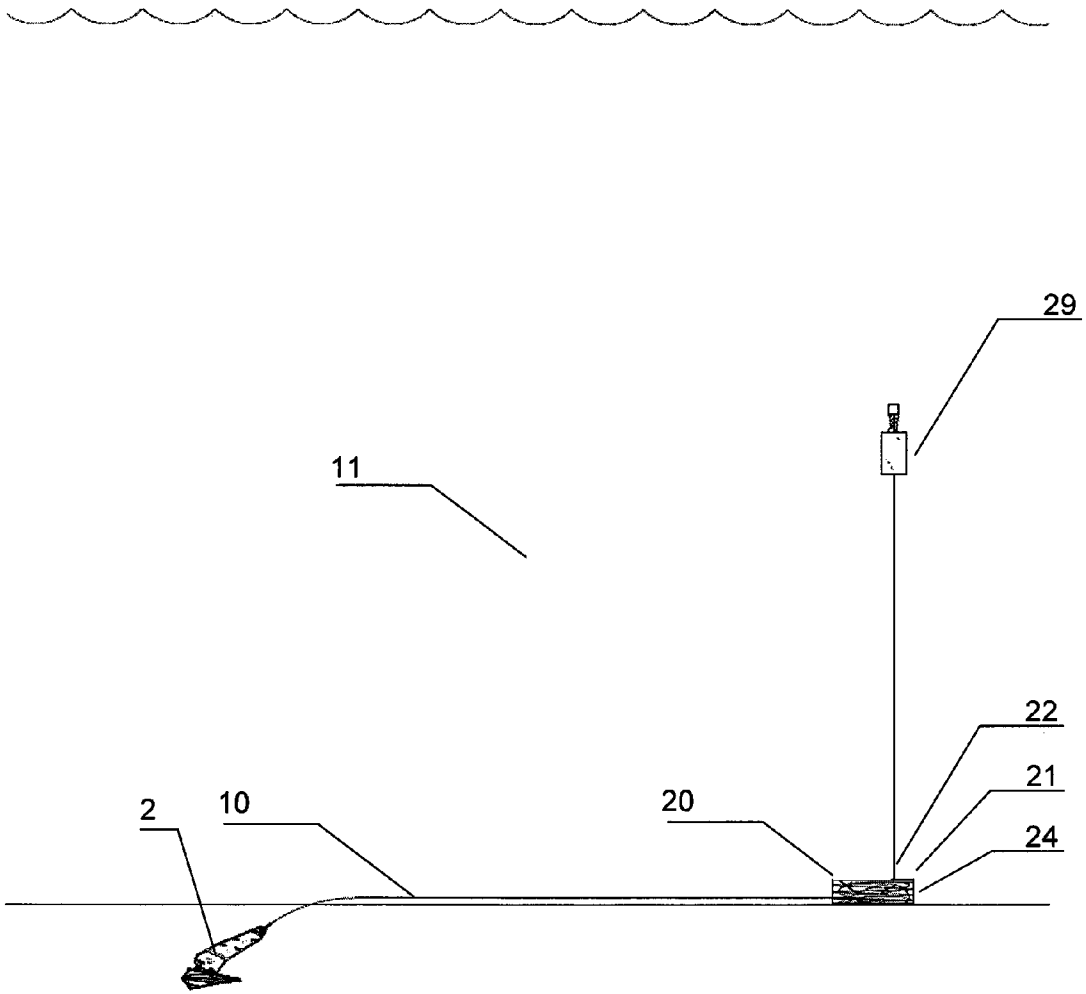

FIG. 10 shows an illustration wherein from the package (24) is extended a wire or line up to a spring buoy (29) arranged for being released and thus by which one may fish up the synthetic fibre rope (20).

Figures 11A, 11B, 11C:
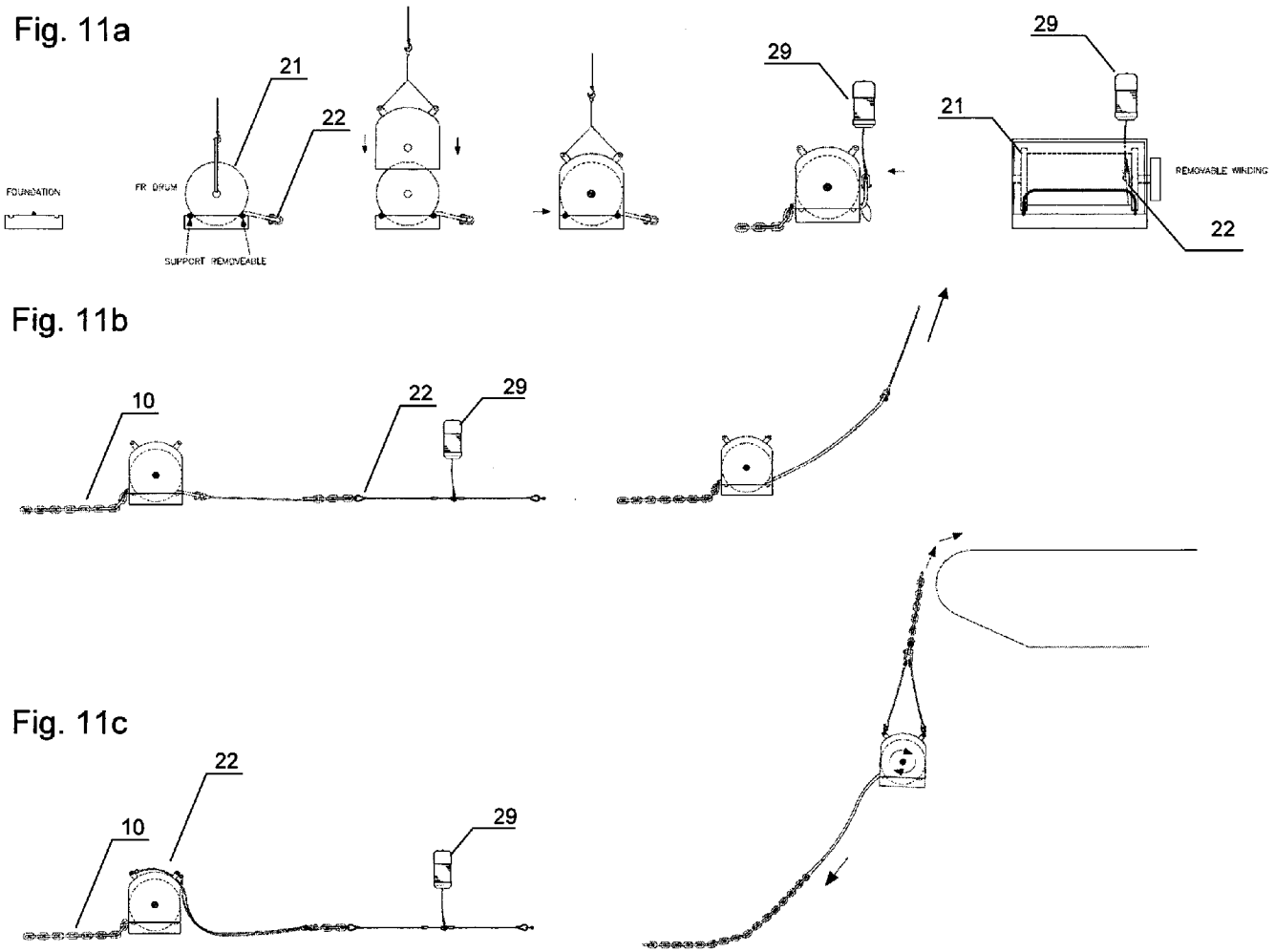

FIG. 11*a* shows a series of elevation views of a drum-shaped container (24) for arranging the synthetic fibre rope (20) within. In the left is shown a foundation for receiving the drum and a cover. Then a fibre rope (20) wound to a coil (21) on a drum is lowered on the foundation. Subsequently a hood cover is lowered over the drum and attached to the foundation. The anchor chain (10) may be attached to the drum or to a first end (27) of the fibre rope (20), and an opposite end (22) is attached to the spring buoy (29). The assembly is set out with the anchor and the seabed anchor chain on the seabed. The spring buoy may then be released when required and the fibre rope (20) pulled out. Also here there may be arranged weak links which release the fibre rope (22) upon a desired pulling force. A releasable motor or brake may be connected to the drum.

FIG. 11*b* shows the embodiment wherein the container with the drum is arranged for standing at the seabed and wherein the end (22) of the fibre rope (20) is arranged for being hauled out by means of the spring buoy line, as shown in the right part of the figure.

FIG. 11*c* shows an alternative embodiment of the drum wherein the container with the drum is arranged for being hauled up as such, and while the rope is fed out a running out end of the fibre rope is connected to the seabed chain, and an opposite end is connected to the drum resulting in that the drum as such is brought to the surface by means of the spring buoy and the spring buoy line. We may, for lighter embodiments of the invention which shall be moored, imagine that the drum as such may be hauled up and mounted on board the platform to be moored, and provided with e.g. hydraulic pressure on the motor which is connected, and thus constitute a winch as such. In such an embodiment an anchor winch chain may be redundant.

DESCRIPTION OF PREFERRED EMBODIMENTS OF THE INVENTION

The invention is in one aspect thus a method of mooring a marine vessel (P) in a desired position by means of three or more anchor lines (11*a*, 11*b*, . . . ) comprising the steps of:

First each anchor line (11) is laid out with an anchor (2) at a desired position with regard to said platform (P), with a seabed chain (10) extending in the direction of the platform's (P) desired position. The seabed chain (10) connected to a synthetic fibre rope's (20) first end (27), said synthetic fibre rope (20) arranged for being extended through the sea and being connected with its opposite, second end (22) to an anchor winch chain (30). When the assembly is connected it may be tightened by an anchor winch (31) on said vessel (P). However, the novel and particular feature of the invention is as follows:

that the synthetic fibre rope (20), prior to the step of connecting with the anchor winch chain (30), is packed to a bundle or coil (21) arranged in a protective sack or container (24) arranged at the seabed, said synthetic fibre rope (20) arranged for being released and pulled out of said container (24) at a predetermined least pulling force directly or indirectly at said synthetic fibre rope's second end (22), and said second end (22) of said synthetic fibre rope (20) being prepared for being picked up for connection with said anchor winch chain (30). The anchor lay-out is thus approximately such as indicated in FIG. 9 in a pattern radiating out from the desired position which is marked by a cross at the seabed.

The predetermined least pulling force may predetermined by means of so-called "weak links" (21*w*) which may be constituted by ropes or metal pieces of desired rupture strength. Those should be weaker than the line, preferably the line (28), which is used for hauling up the synthetic fibre rope (20).

In order to complete the operation and utilise the invention one may in a preferred embodiment of the method according to the invention further conduct the following steps:

place the vessel (P) in the desired position, pick up [picking up] each synthetic fibre rope's second end (22) and conduct the connection of those with their assigned anchor winch chains (30).

tighten the anchor winch chains (30) by means of anchor winches (31) on the platform (P) until it resides sufficiently bound at the desired position. How much each anchor winch chain shall be tightened is a task for the person skilled in the art.

The spring buoy line's (28) breaking load may be e.g. 50 tonnes. The fibre rope (20) may have a breaking load considerably higher, such as 600 tons.

According to an embodiment of the method of the invention the second end (22) of the synthetic fibre rope (20) be picked up by a ROV or a crane or an operative combination of a ROV and a crane.

According to an embodiment of the method of the invention the second end (22) of the synthetic fibre rope (20) may be provided with a line (28) to a buoy (29) wherein the line (28) is applied to pick up the second end (22) up to a surface vessel. According to a preferred embodiment of this method the line (28) is packed in the buoy (29) and by remote control releasable by means of a signal so as for the spring buoy (29) to rise to the surface and being caught, whereupon the synthetic fibre rope's (20) one end is hauled up and coupled to the anchor winch chain (30).

The above thus describes a method according to the invention. According to another aspect of the invention it is an anchor spread layout for mooring a marine vessel (P) in a desired position. This is also, from a material point of view, illustrated in FIG. 9. The anchor spread layout comprises the following components:

three or more, here shown as eight, radially spread anchor lines (11*a*, 11*b*, 11*c* . . . ), each comprising an anchor (2) in a first, outer end of a seabed chain (10) extending with a second, inner end in the direction of the desired position. The inner end of the seabed chain (10) is connected to a first, outer end (27) of a synthetic fibre rope (20) which at its second, opposite end (22) is arranged to be connected to an anchor winch chain (30) on the vessel (P). The novel and distinctive in this aspect of the invention are the following features:

that the synthetic fibre rope (20) is packed to a bundle or coil (21) arranged in a protective container (24) and arranged for being released and extended from the container at a least pulling force directly or indirectly on a second end (22) of the synthetic fibre rope (20), and the bundle or coil (21) being arranged at the seabed with the second end (22) prepared for being picked up for becoming connected with the anchor winch chain (30).

As explained about the method above, one may then arrange the marine vessel, such as the platform (P), in approximately the desired position, fish up the ends (22) of the fibre ropes (20), and conduct the connection to the respective anchor winch chains and complete the mooring.

The anchor spread layout according to the invention may comprise that the container (24) is constituted generally of a sack or bag (24) and provided with an aperture (25) for releasing the synthetic fibre rope (20), said aperture 825) being arranged to be torn open or in other way being opened when the end (22) is subject to load.

In a preferred embodiment of the invention the first end (27) of the synthetic fibre rope is connected to a first end (23*a*) of a relatively rigid support body (23) arranged as a brace of the bundle or coil (21) and arranged for being connected with the opposite end (23*b*) of the support body (23) to the seabed chain (10). This is illustrated in FIG. 6*a* where reference numeral (24) indicates a folded sack with a bundled synthetic fibre rope (20), were reference numeral 25 indicates a releasable lock mechanism, such as exemplified by a large pair of "velcro" bands or a weakening arranged for being torn apart at a given pulling force at the end (22) of the synthetic fibre rope.

In an alternative embodiment of the invention the packed bundle or coil (21) may be arranged on a drum (14), said drum arranged for being picked up together with the second, free end (22). Examples of such a drum is shown in FIG. 7*b*.

In a third aspect of the invention it may be defined as a mooring component for use in an anchor spread layout for mooring a marine vessel (P). The mooring component comprises the following material features:

A first, outer end (27) of a synthetic fibre rope (20) is arranged for being connected to a seabed chain (10) which shall extend to an anchor (2). A second, inner end (22) of the synthetic fibre rope (20) is arranged for being connected to an anchor winch chain (30) to an anchor winch (31) on the vessel (P). The novel and distinctive by this aspect of the invention is, as above:

that the synthetic fibre rope (20) is packed to a bundle or coil (21) arranged in a protective container 824) and arranged for being released and extended from the container upon a given pulling force directly or indirectly at the second end (22) of the synthetic fibre rope (20), and that the container (24) with the bundle or coil (21) is arranged for being placed at the seabed with the second end (22) prepared for being picked up for being connected with the anchor winch chain (30).

In an embodiment of the invention the container (24) is constituted by a sack or bag (24) and is provided with an aperture (25, 24*a*) arranged for releasing the synthetic fibre rope (20), wherein the aperture (25, 24*a*) is provided with elements (24*b*) as so-called weak links (24*b*) arranged for being pulled apart when the end (22) is loaded.

The first end (27) of the synthetic fibre rope may be coupled to a first end (23*a*) of a relatively rigid support body (23), please see FIG. 6*a*, arranged as a brace for the bundle or coil (21) and arranged for being connected to se seabed chain (10) via the opposite end (23*b*) of the support body (23).

The support body's first end (23*a*) may further also comprise a towing eyelet (26) arranged for being connected to a tensioner line for laying out the anchor (2) with the synthetic fibre rope's (20) container (24), so as for enabling laying out the entire length in one single operation for subsequently residing ready on the seabed.

The synthetic fibre rope (20) may exemplary be a so-called polyester rope of very large diameter, and with a breaking load adapted to the use as an anchor line, e.g. 600 tonnes.

The invention claimed is:

1. A method of mooring a marine vessel in a desired position using three or more anchor lines comprising anchors with a seabed chain connected to a first end of a rope, said method comprising the steps of:

laying out each anchor line with said anchor at a desired position relative to said vessel, with said seabed chain extending in the direction of a desired position of said vessel, said rope for being extended through the sea and being connected with an opposite second end to an anchor winch chain on said vessel and tightened;

packing all or part of said rope, prior to the step of connecting with the anchor winch chain, into a bundle or coil in a protective container placed at the seabed, said second end of said rope for being released and pulled out of said container at a predetermined least pulling force; and preparing said second end of said rope for being picked up for connection with said anchor winch chain.

2. The method according to claim 1, further comprising the steps of:

placing said vessel in said desired position;

picking up a second end of each rope, pulling out said rope from said container and connecting said second end one by one to corresponding said anchor winch chains; and tightening said ropes with said anchor winch chains by means of said anchor winches until said vessel is in said desired position.

3. The method according to claim 1, wherein said step of releasing said second end of said rope further comprises the step of picking up said second end of said rope by an ROV.

4. The method according to claim 1, wherein said second end of said rope is provided with a spring buoy line to a spring buoy, said spring buoy line being applied for picking up said second end to a surface vessel.

5. The method according to claim 4, wherein said spring buoy line is packed in said spring buoy and is remotely releasable by means of a signal so as for said spring buoy to rise to the sea surface and be collected.

6. An anchor spread for mooring a marine vessel in a desired position, comprising:

three or more radially spread anchor lines, each anchor line comprising an anchor in a first, outer end of a seabed chain extending with a second, inner end in the direction towards said desired position and which is connected to a first, outer end of a rope with a second, opposite end for being connected to an anchor winch chain of said vessel, wherein said rope is packed into a bundle or coil arranged in a protective container, said second end of said rope for being released and pulled out from said container by means of a least pulling force directly or indirectly at said opposite second end of said rope, wherein said bundle or coil is placed at the seabed with said second end prepared for being picked up for connecting to said anchor winch chain, and wherein weak links are arranged in said bundle or coil for controlling said release of said rope in an ordered manner, said weak links having a lower ultimate strength than said rope.

7. The anchor spread according to claim 6, wherein said container is constituted by a sack or bag provided with an aperture for releasing said rope, said aperture comprising elements for being torn apart when said end is loaded.

8. The anchor spread according to claim 6, wherein said first end of said rope is connected to a first end of a rigid support body arranged as a brace for said bundle or coil, said support body having an opposite second end for being connected to said seabed chain.

9. The anchor spread according to claim 6, wherein said packed bundle or coil is arranged on a drum for being picked up with said second, free end.

10. A mooring component for use in an anchor spread for mooring a marine vessel, comprising:

a first, outer end of a rope arranged for being connected to a seabed chain for extending to an anchor; and an opposite, inner end of said rope arranged for being connected to an anchor winch chain of an anchor winch of said vessel, wherein said rope is packed into a bundle or coil arranged in a protective container and is arranged for being released and pulled out from said container at a given pulling force directly or indirectly at a second end of said rope, wherein said bundle or coil is for being placed at the seabed with said second end prepared for being picked up for connecting to said anchor winch chain, wherein said first end of said rope is connected to a first end of a rigid support body arranged for bracing said bundle or coil and arranged for being connected with a second, opposite end of said support body to said seabed chain.

11. The mooring component according to claim 10, wherein said container is constituted by a sack or bag with an aperture for releasing said rope, said aperture provided with elements arranged for breaking while being pulled apart when said end is loaded.

12. The mooring component according to claim 10, wherein the first end of said support body further comprises a towing eyelet for a towing line for laying out said anchor, said seabed chain and said support body with said container.

* * * * *